United States Patent [19]

Maltz

[11] Patent Number: 4,504,989

[45] Date of Patent: Mar. 19, 1985

[54] INFLATABLE SUPPORT ARRANGEMENT

[76] Inventor: Dean I. Maltz, 1011 Hazel Pl., Woodmere, N.Y. 11598

[21] Appl. No.: 507,968

[22] Filed: Jun. 27, 1983

[51] Int. Cl.[3] ..... A47C 27/10; A47C 4/54

[52] U.S. Cl. ..... 5/455; 5/454; 297/DIG. 3; 441/41

[58] Field of Search ..... 5/455, 449, 441, 453, 5/454, 456; 297/DIG. 3; 441/41, 129

[56] References Cited

U.S. PATENT DOCUMENTS

| | | | |
|---|---|---|---|
| 2,437,602 | 3/1948 | Hann | 297/DIG. 3 |
| 2,698,028 | 12/1954 | Lee et al. | 5/454 |
| 3,029,109 | 4/1962 | Nail | 297/461 |
| 3,068,494 | 12/1962 | Pinkwater | 441/129 |
| 3,533,113 | 10/1970 | Stamberger | 5/454 |

*Primary Examiner*—Alexander Grosz

*Attorney, Agent, or Firm*—Kirschstein, Kirschstein, Ottinger & Israel

[57] ABSTRACT

An inflatable support arrangement includes a plurality of first wall portions each of which bounds an annular inflatable zone and surrounds a central region, and second wall portions which are sealingly connected to the first wall portions and span the distances therebetween to separate the central region from the exterior of the support arrangement. A main one-way inlet valve is arranged in the second wall portion and permits air to be aspired therethrough into the central region when the second walls are moved apart. An auxiliary one-way inlet valve communicates the central region with one of the annular zones and permits air only to flow from the central region into the annular compartment when the end walls are moved together. The first wall portions are sealingly secured to one another by respective seams arranged between the first wall portions, the seams being perforated by respective orifices that communicate the annular zones with one another but are separated from the central region and from the exterior of the support arrangement by the respective seam. An outlet valve for deflating the support arrangement is mounted on one of the first wall portions and communicates the annular zones with the exterior of the support arrangement when open, thus permitting air present in such annular compartments and flowing thereinto through the auxiliary one-way valve to escape into the ambient atmosphere.

20 Claims, 9 Drawing Figures

INFLATABLE SUPPORT ARRANGEMENT

BACKGROUND OF THE INVENTION

The present invention relates to inflatable articles of manufacture in general, and more particularly to an inflatable support arrangement usable as a support for a person, either in the sitting position, or in a prostrate position.

There are already known various inflatable articles of manufacture which serve various purposes, either as toys or as utilitarian articles, such as rafts, mattresses, chairs, hassocks, floating lounge chairs, or the like. Various constructions of such known inflatable articles of the type here under consideration are disclosed, for instance, in U.S. Pat. Nos. 2,437,602; 3,029,109; 3,125,377; 3,533,113; 3,572,836; 3,898,703; and 4,232,477. So, for instance, the U.S. Pat. No. 2,437,602 discloses an inflatable article which includes a plurality of compartments which are separated from one another by respective internal walls which have one-way flap valves mounted therein, such that air can flow only in one direction through the respective valve. Hence, by compressing and expanding the compartment whose valve communicates with the exterior, air is transferred through the respective one-way valves into the adjoining compartments, or ambient air is drawn into the initial compartment, respectively. However, this conventional inflatable article leaves much to be desired as far as its stability and other properties are concerned, especially since the initial compartment is usually underinflated. Also, the compartments are relatively large so that the stability of even the other compartments is relatively low. On the other hand, the U.S. Pat. No. 3,029,109 discloses inflatable articles which have relatively smaller compartment so that the stability of the article is somewhat improved. Yet, the walls separating the compartments are perforated so that air can relatively freely flow between the compartments when outside pressure is applied to the article, so that the article again will be distor ed. Thus, it may be seen that the conventional inflatable articles have a multitude of drawbacks and hence have not found as widespread use as otherwise possible.

SUMMARY OF THE INVENTION

Accordingly, it is a general object of the present invention to avoid the disadvantages of the prior art.

More particularly, it is an object of the present invention to provide an inflatable support which does not possess the disadvantages of the conventional articles of this type.

Still another object of the present invention is so to construct the inflatable support of the type here under consider ation as to achieve the desired degree of inflation of the various sections thereof in a rapid fashion and in a relatively simple manner, and to maintain the degree of inflation throughout the period of use of the inflatable support regardless of the direction of application of outside pressure to the support arrangement.

It is yet another object of the present invention so to design the inflatable support of the above type as to make the same stable in its inflated condition.

It is an additional object of the present invention so to design the inflatable support of the above type as to make the same functionally portable, i.e. the support is user-inflatable, rapid to inflate and deflate, small and light enough to be handcarried, compact upon deflation for ease of transport and storage, and can support a user in a comfortable position for a relatively long period of time while maintaining its own stability and shape under multi-directional pressure.

A concomitant object of the present invention is to develop an inflatable support of the above type which is simple in construction, inexpensive to manufacture, easy to use, and reliable in operation nevertheless.

In pursuance of the objects and others which will become apparent hereafter, one feature of the present invention resides in an inflatable support arrangement which comprises first wall means including at least one flexible first wall portion bounding at least one enclosed annular zone and circumferentially completely surrounding a central region; second wall means including at least two flexible second wall portions having respective peripheries sealingly connected to the first wall means all around the central region to separate the latter from the exterior of the support arrangement; main one-way inlet valve means for admitting air from the exterior into the central region to inflate the support arrangement, and for preventing the thus admitted air from escaping to the exterior; and auxiliary one-way inlet valve means interposed between the central region and the annular zone for transferring air from the former into the latter and for preventing the transferred air from returning into the central region so that, in the inflated condition of the support arrangement, the air pressure in the annular zone causes the first wall means to form a relatively rigid, circumferentially complete shape-determining circumferential frame of the support arrangement regardless of the air pressure prevailing in the central region. A particular advantage of this expedient is that the central region may be underinflated, either by accident or by design, and yet the annular zone, if properly inflated, will cause the first wall portion to maintain the stability of the support arrangement. In other words, the central region can be inflated to an extent desired for giving the person resting on the support arrangement the required degree of comfort, and yet the first wall means will retain the shape of the support arrangement as considered in the circumferential direction. Another advantage of this expedient is that the weight of the person resting on the support arrangement generates a continual downward pressure on the central region and continually pushes air to the annular zone, providing a greater pressure in the annular zone to resist the downward pressure, thereby promoting the overall stability.

Advantageously, the first wall means further includes at least one additional first wall portion bounding at least one additional annular zone also surrounding the central region and substantially aligned with the annular zone in an axial direction of the support arrangement; and the support arrangement further includes means for communicating the annular zones with one another across the first wall portions. In this manner, the annular zones communicate with one another, without sacrificing the shape-retaining function of the first wall means. In this construction, it is particularly advantageous when one of the second wall portions is sealingly connected to the first wall portion, and the other of the second wall portions is sealingly connected to the additional first wall portion. This means that the second wall portions are spaced from one another in the inflated condition of the support arrangement not only in the middle of the arrangement, but also at the peripheries of the second wall portions.

A particularly simple and otherwise advantageous construction of the support arrangement of the present invention is obtained when the first wall portion and the additional first wall portion are connected to one another at a seam; and when the communicating means includes a plurality of orifices sealingly passing through the seam and opening into the annular zone and into the additional annular zone.

In accordance with a currently preferred aspect of the present invention, the first wall means further includes at least one further first wall portion bounding at least one further annular zone, the further first wall portion being interposed between the first wall portion and the additional first wall portion in substantial alignment therewith. In this context, it is especially advantageous when the first wall portions are sealingly secured to one another in succession at respective seams, and when the communicating means communicates the successive ones of the annular zones with one another and includes a plurality of orifices sealingly passing through each of the seams.

A particularly advantageous construction of the support arrangement of the present invention is obtained when the support arrangement includes first wall means including a plurality of first wall portions aligned with one another in an axial direction of the support arrangment, sealingly secured to one another at respective seams arranged between the respective individual successive first wall portions, individually bounding respective enclosed annular zones, having a plurality of orifices passing through the respective seams to communicate the annular zones in series with one another, and collectively surrounding a central region; second wall means including at least two second wall portions having respective peripheries sealingly connected to those of the first wall portions which are arranged at the respective axial ends of the support arrangement all around the central region to separate the latter from the exterior of the support arrangement; main one-way inlet valve means arranged in at least one of the second wall portions for admitting air from the exterior into the central region to inflate the support arrangement, and for preventing the thus admitted air from escaping to the exterior; and auxiliary one-way inlet valve means interposed in one of the first wall means between the central region and the respective annular zone for transferring air from the former into the latter and for preventing the transferred air from returning into the central region.

According to a further advantageous facet of the pres ent invention, the support arrangement further comprises handgrip means connected to each of the second wall portions and operative for displacing the second wall portions apart and together for drawing ambient air through the main one-way inlet valve means into the central region, and for expelling air through the auxiliary one-way inlet valve means from the central region into the annular zone, respectively. In this connection, it is especially advantageous when the handgrip means includes a substantially sheet-shaped handgrip element peripherally secured to the respective second wall portion and having a plurality of openings therein for passage of fingers of the user of the arrangement therethrough into engagement of the handgrip element from behind. Advantageously, the handgrip element has at least one dimension which is smaller than the corresponding dimension of the second wall portion, so that the periphery of the handgrip element is spaced from the first wall portion. It is especi ally advantageous when the handgrip element is substantially equidistantly spaced from the first wall portion all around its periphery. However, it is also advantageous when the handgrip element is arranged substantially centrally of the respective second wall portion and is spaced from the first wall portion all around its periphery.

The support arrangement may have a variety of shapes. However, it is particulary advantageous when the first wall portions extend along a substantially circular cylindrical surface to give the support arrangement the shape of a hassock. It is further advantageous when the first wall portions extend along a substantially rectangular prism surface to give the support arrangement the shape of a mattress .

The support arrangement of the present invention also advantageously includes control outlet valve means arranged in the first wall means and operative for selectively controlling the communication of the respective enclosed annular zone with the exterior of the support arrangement for deflating the latter when desired.

The novel features which are considered as characteristic of the invention are set forth in particular in the appended claims. The improved inflatable support arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
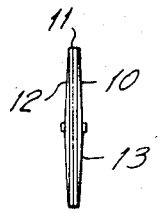
FIG. 1 is a side elevational view of the inflatable support of the present invention in its deflated position and orient ed for inflation.

Referring now to the drawing in detail, and first to FIG. 1 thereof, it may be seen that the reference numeral 10 has been used therein to identify a support arrangement according to the present invention in its entirety. While the support arrangement 10 has been illustrated in the drawing as constituting a portable inflatable hassock, it is to be understood that the inflatable support arrangement 10 can have different shapes and, consequently, different functions. So, for instance, the support arrangement 10 can be substantially rectangular or prismatic when inflated, and may be so dimensioned that a person can assume a prostrate position thereon, so that the thus configurated support arrangement 10 then serves as a mattress. Regardless of the shape and dimensions of the support arrangement 10, however, the operating characteristics there of will be the same or closely similar, so that the present invention will be described only as embodied in the portable inflatable hassock.

Figure 2:
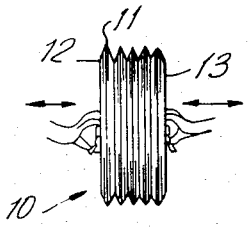
FIG. 2 is a view similar to that of FIG. 1 but during the inflation of the inflatable support.

The support arrangement 10 is shown in FIG. 1 in its deflated or collapsed condition in which it is essentially flat and assumes only a minimum amount of space. The support arrangement or hassock 10 has a peripheral region 11 and a central region delimited in the axial direction of the support arrangement 10 by two end walls 12 and 13. As shown in FIG. 2, the peripheral region 11 is folded in an accordion-like fashion, with the folds becoming gradually separated as the two end walls 12 and 13 are being pulled apart in the directions of the double-headed arrows shown in FIG. 2

Figure 3:
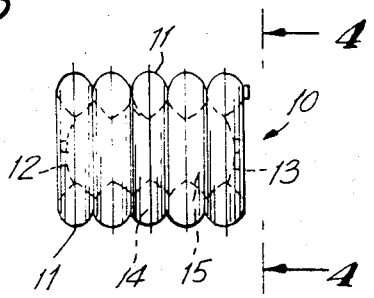
FIG. 3 is a view similar to those of FIGS. 1 and 2 but in the fully inflated condition of the support arrangement.

In FIG. 3, the support arrangement 10 is shown in its fully inflated state which it had acquired after the end walls 12 and 13 have been repeatedly moved together and apart in the directions of the double-headed arrows shown in FIG. 2 by the person intending to use the support arrangement 10. It may be seen that the peripheral region 11 is constituted by a multitude of inflated annular regions or zones 14, while the central region is peripherally surrounded by the inflated annular zones 14 and axially delimited by the two end walls 12 and 13, thus forming an inflated chamber 15.

Figure 4:
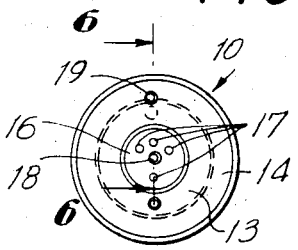
FIG. 4 is an end view of the support arrangement taken in the direction of the arrows 4—4 of FIG. 3.

FIG. 4 shows that a substantially circularly disc-shaped handgrip element or layer is peripherally secured to the end wall 13, this handgrip element being identified by the reference numeral 16. The handgrip element 16 is situated substantially centrally of the end wall 13 and its periphery is inwardly spaced from the periphery of the end wall 13. A similar or identical handgrip element 16 is secured to the end wall 12 as well. Preferably, the handgrip element 16 is secured to the respective end wall 12 or 13 by a thermal weld which extends all around the periphery of the handgrip element 16 and secures the same to the respective end wall 12 or 13.

Figure 5:
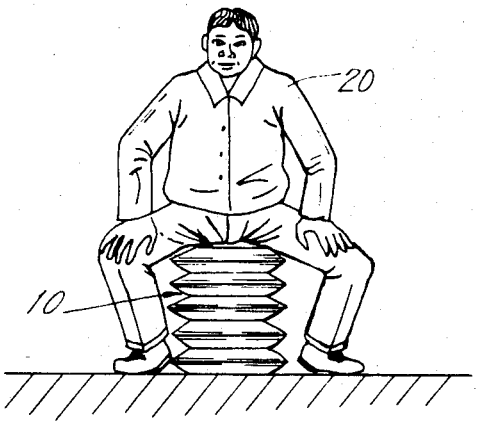
FIG. 5 is a view of the support arrangement in its condition as shown in FIG. 3 but reoriented to enable a person to sit thereon.

The handgrip element 16 is provided with a plurality of orifices or openings 17 which are preferably so distributed as to permit convenient insertion of fingers of the prospective user thereinto and engagement with the handgrip member 16 from behind so as to be able to control the movement of the end walls 12 and 13 together and particularly apart. FIG. 4 also indicates that the support arrangement 10 is provided with a main inlet valve 18 and with an outlet valve 19 through which the support arrangement 10 can be inflated and deflated, respectively. FIG. 5 indicates how the inflated support arrangement 10 is to be used by a user 20, for instance, while waiting for public transportation or the like.

Figure 6:
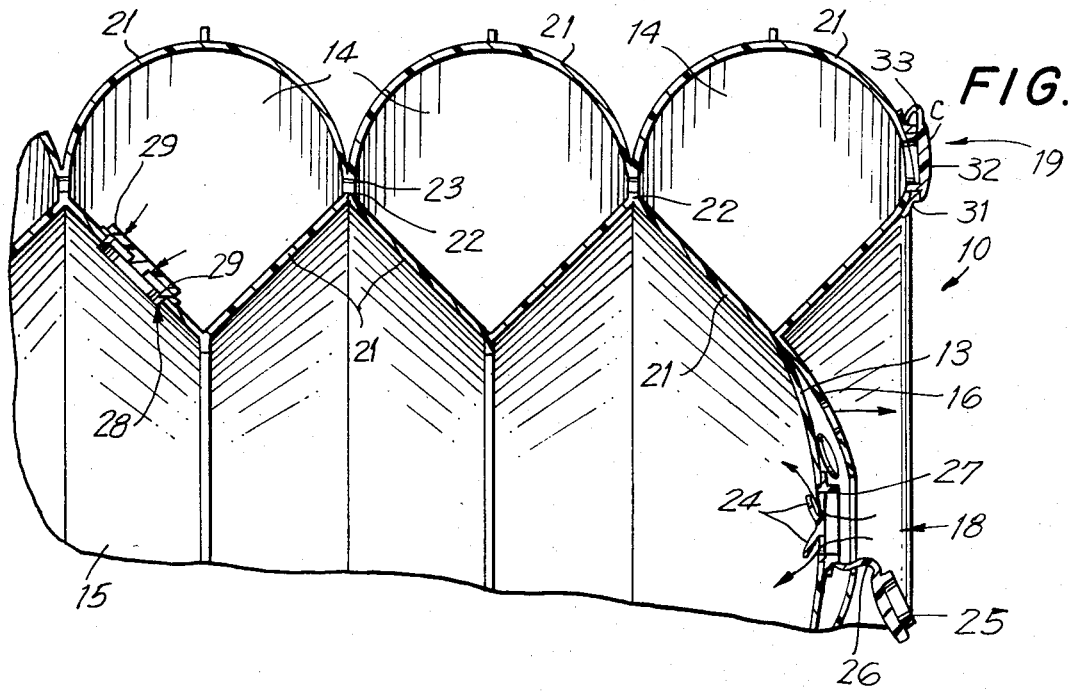
FIG. 6 is an enlarged partial cross-sectional view through the support arrangement taken along the plane indicated by the arrows 6—6 of FIG. 4 and showing the conditions existing during one phase of the inflation of the support arrangement.
Figure 7:
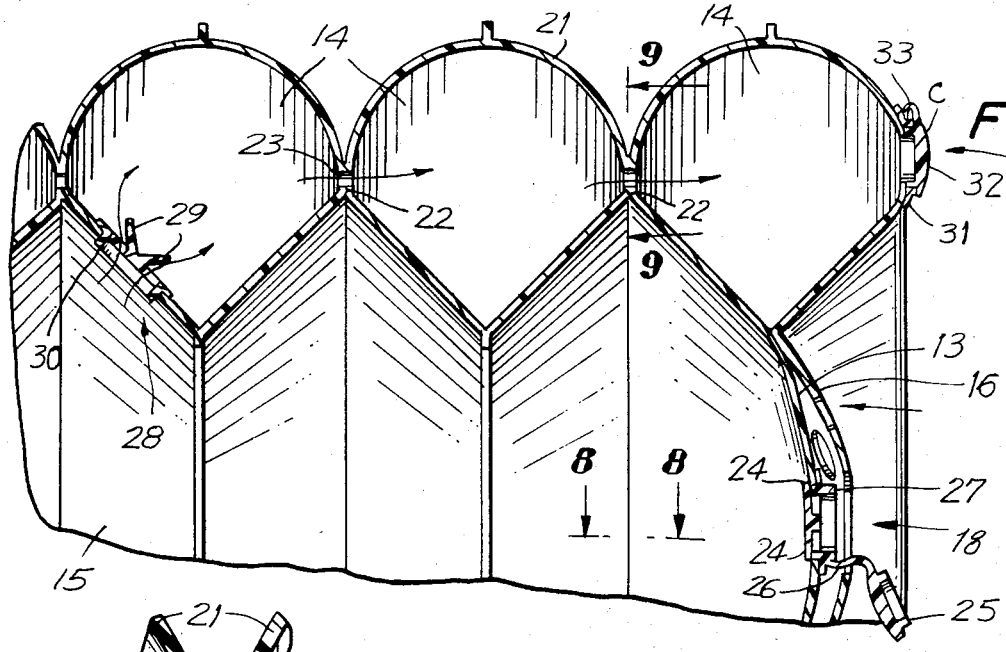
FIG. 7 is a view corresponding to that of FIG. 6 but showing the conditions existing during another phase of inflation.
Figure 8:
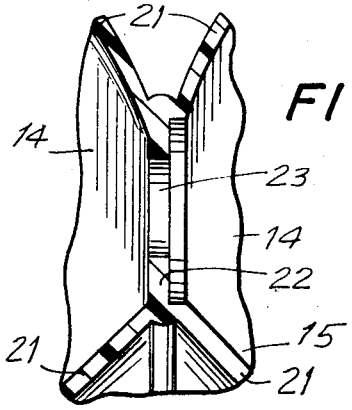
FIG. 8 is a further enlarged view taken on line 8—8 of FIG. 7.
Figure 9:
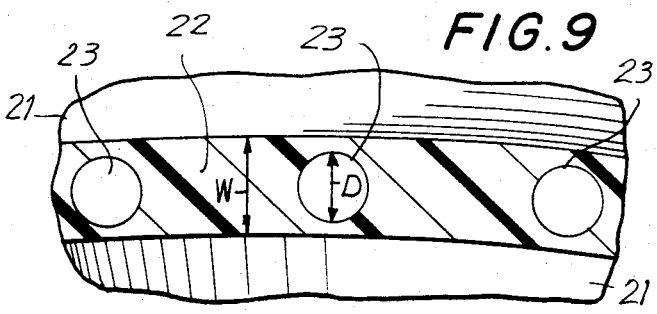
FIG. 9 is a sectional view at the scale of FIG. 8 but taken along the line 9—9 of FIG. 7.

Further details of the construction and operation of the support arrangement 10 can be ascertained from FIGS. 6 and 7. As shown therein, the individual annular compartments 14 are respectively bounded by individual wall portions 21 which separate the compartments 14 from the exterior of the support arrangement 10, from the central compartment 15, and from one another. The wall portions 21 are secured to one another by respective seams, particularly by thermally welded seams, 22 which are situated between the individual compartments or zones 14 and extend all around the central chamber or compartment 15, thus separating the latter from the exterior of the support arrangement 10. As shown especially in FIGS. 8 and 9, the wall portions 21 are provided with respective orifices 23 which sealingly communicate the individual annular zones 14 with one another through the respective seam 22. Such orifices can be dis tributed regularly or irregularly, so long as their cumulative flowthrough cross-sectional area through the respective seam 22 is sufficiently large to permit virtually unimpeded flow of the air therethrough between the individual compartments 14. At the same time, the respective seam 22 prevents communication of the orifices 23 either with the exterior of the support arrangement 10 or with the internal chamber 15. The distribution of a plurality of orifices 23 around the respective seam 22 permits a more uniform, laminar air flow between the individual compartments 14. No fracturing or stress lines occur at the sites of the orifices during inflation or deflation, or even during use, i.e. when a person is supported by the arrangement. The heat-fused seam has a high structural integrity due to its substantially planar and broad configuration (see FIG.8) and predetermined width W (see FIG.9) whose dimension is larger than the diameter D of the circular orifices, as well as its thickness which is thickest along the periphery of the seam. Each planar seam 22 is much reinforced as compared to conventional linear edge seams which are highly prone to tearing after prolonged usage.

The main inlet valve 18 is shown to be constructed as a one-way flap valve including a plurality of flaps 24 which dissociate themselves from the associated seats when subatmospheric pressure prevails in the internal chamber 15 during the movement of the end walls 12 and 13 away from one another, as shown in FIG. 6, and which engage the associated valve seats with sealing action when the pressure in the internal chamber 15 exceeds the ambient pressure, as shown in FIG. 7 during the movement of the end walls 12 and 13 toward one another. Thus, the main one-way inlet valve 18 permits aspiration of ambient air into the internal chamber 15 during the movement of the end walls 12 and 13 apart, and prevents the aspired air from escaping therethrough to the exterior of the support arrangement 10. The main inlet valve 18 is further provided with a protective cap 25 which is connected to the end wall 12 or 13, or to a body of the inlet valve 18 which is sealingly secured to the end wall 12 or 13, by a hinge 26 which permits the protective cap 25 to move toward and away from the valve body but prevents the same from becoming misplaced or lost. The protective cap cooperates with a neck portion 27 of the valve body to prevent air leakage through the main inlet valve 18.

At least one auxiliary one-way inlet valve 28 of a construction similar to that of the main one-way inlet valve 18 is mounted in one of the wall portions 21 between the central compartment or chamber 15 and one of the annular compartments or zones 14. The auxiliary one-way valve 28 again includes a plurality of flaps 29 which cooperate with respective seats provided on a body 30 of the valve 28 to let air flow only from the compartment 15 into the annular compartment 14 when the pressure in the former exceeds that in the latter, but not in the opposite direction. Thus, the auxiliary one-way inlet valve 28 opens during the inflation of the support arrangement 10 as the end walls 12 and 13 move together, as shown in FIG. 7, and is closed when the end walls 12 and 13 are moving apart, as shown in FIG. 6. In this manner, it is assured that the pressure prevailing in the annular compartments 14 is always at least equal to, or greater than, the pressure in the central compartment 15. Thus, the wall portions 21 will always be properly inflated, even when the compartment 15 is underinflated in the inflated condition of the support arrangement 10, and will thus serve to preserve the stability of the arrangement 10 by serving as a relatively rigid frame. Hence, the central compartment need only be inflated to an extent necessary for assuring comfort for the user of the support arrangement, since the shape stability is assured by the inflated annular wall portions 21 rather than by the end walls 12 and 13, so that the latter can be permitted to yield to provide a comfortable seating or lying surface for the user.

The outlet valve 19 is shown to be constructed as a two-way valve which includes a body 31 including a neck portion and sealingly secured to the respective wall portion 21, and another protective cap 32 which sealingly engages the neck portion of the body 31 in its closed position and is connected to the body 31 by a hinge 33 to be able to be removed from the neck portion 32 for deflation of the arrangement 10 through the outlet valve 19 without fear of misplacement or loss of the protective cap 32.

It will be understood that each of the elements described above, or two or more together, may also find a useful application in other types of arrangements differing from the type described above.

While the invention has been illustrated and described as embodied in an inflatable hassock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. An inflatable support arrangement, comprising first wall means including at least one flexible first wall portion bounding at least one enclosed annular zone and circumferentially completely surrounding a central region;

second wall means including at least two flexible second wall portions having respective peripheries sealingly connected to said first wall means all around said central region to separate the latter from the exterior of the support arrangement;

main one-way inlet valve means for admitting air from said exterior into said central region to inflate the support arrangement, and for preventing the thus admitted air from escaping to said exterior; and auxiliary one-way inlet valve means interposed between said central region and said annular zone for transferring air from the former into the latter and for preventing the transferred air from returning into said central region so that, in the inflated condition of the support arrangement, the air pressure in said annular zone causes said first wall means to form a relatively rigid, circumferentially complete shape-determining circumferential frame of the support arrangement regardless of the air pressure prevailing in said central region.

2. The support arrangement as defined in claim 1, wherein said first wall means further includes at least one additional first wall portion bounding at least one additional annular zone also surrounding said central region and substantially aligned with said annular zone in an axial direction of the support arrangement; and further comprising means for communicating said annular zones with one another across said first wall portions.

3. The support arrangement as defined in claim 2, wherein one of said second wall portions is sealingly connected to said first wall portion, and the other of said second wall portions is sealingly connected to said additional first wall portion.

4. The support arrangement as defined in claim 2, wherein said first wall portion and said additional first wall portion are connected to one another at a seam; and wherein said communicating means includes a plurality of orifices sealingly passing through said seam and opening into said annular zone and into said additional annular zone.

5. The support arrangement as defined in claim 2, wherein said first wall means further includes at least one further first wall portion bounding at least one further annular zone, said further first wall portion being interposed between said first wall portion and said additional first wall portion in substantial alignment therewith.

6. support arrangement as defined in claim 5, wherein said first wall portions are sealingly secured to one another in succession at respective seams, and wherein said communicating means communicates the successive ones of said annular zones with one another and includes a plurality of orifices sealingly passing through each of said seams.

7. The support arrangement as defined in claim 6, wherein said first wall portions extend along a substantially circular cylindrical surface to give the support arrangement the shape of a hassock.

8. The support arrangement as defined in claim 6, wherein said first wall portions extend along a substantially rectangular prism surface to give the support arrangement the shape of a mattress.

9. The support arrangement as defined in claim 1, and further comprising handgrip means connected to each of said second wall portions and operative for displacing said second wall portions apart and together for drawing ambient air through said main one-way valve means into said central region, and for expelling air through said auxiliary one-way valve means from said central region into said annular zone, respectively.

10. The support arrangement as defined in claim 9, wherein said handgrip means includes a substantially sheet-shaped handgrip element peripherally secured to the respective second wall portion and having a plurality of openings therein for introduction of fingers of the user of the support arrangement thereinto and engagement behind said handgrip element.

11. The support arrangement as defined in claim 10, wherein at least one dimension of said handgrip element is smaller than the corresponding dimension of said second wall portion so that the periphery of the handgrip element is spaced from said first wall portion.

12. The support arrangement as defined in claim 11, wherein said handgrip element is substantially equidistantly spaced from said first wall portion all around its periphery.

13. The support arrangement as defined in claim 11, wherein said handgrip element is arranged substantially centrally of the respective second wall portion and is spaced from said first wall portion all around its periphery.

14. The support arrangement as defined in claim 1, and further comprising control outlet valve means arranged in said first wall means and operative for selectively controlling the communication of said enclosed annular zone with said exterior for deflating the support arrangement when desired.

15. An inflatable support arrangement, comprising first wall means including a plurality of first wall portions aligned with one another in an axial direction of the support arrangement, sealingly secured to one another at respective seams arranged between the individual successive first wall portions individually bounding respective enclosed annular zones, having a plurality of orifices passing through the respective seams to communicate said annular zones in series with one another, and collectively surrounding a central region;

second wall means including at least two second wall portions having respective peripheries sealingly connected to those of said first wall portions which are arranged at the respective axial ends of the support arrangement all around the central region to separate the latter from the exterior of the support arrangement;

main one-way inlet valve means arranged in at least one of said second wall portions for admitting air from said exterior into said central region to inflate the support arrangement, and for preventing the thus admitted air from escaping to said exterior; and auxiliary one-way inlet valve means interposed in one of said first wall means between said central region and the respective annular zone for transferring air from the former into the latter and for preventing the transferred air from returning into said central region so that, in the inflated condition of the support arrangement, the air pressure in said respective annular zone causes said first wall means to form a relatively rigid, circumferentially complete shape-determining circumferential frame of the support arrangement regardless of the air pressure prevailing in said central region.

16. The support arrangement as defined in claim 15, and further comprising outlet valve means arranged in one of said first wall portion for selectively controlling the communication between the respective annular zone and said exterior for deflating the support arrangement when desired.

17. The support arrangement as defined in claim 15, and further comprising handgrip means including two handgrip portions each secured to one of said second wall portions for moving the second wall portions apart for aspiring ambient air through said main one-way valve means into said central region, and toward each other for expelling air from said central region through said auxilary one-way valve means into said annular zones.

18. The support arrangement as defined in claim 17, wherein each of said handgrip portions includes a sheet-shaped handgrip layer separate from and peripherally secured to the respective second wall portion substantially centrally thereof and including a plurality of openings for passage of fingers of the user of the arrangement therethrough into engagement of said layer from behind.

19. The support arrangement as defined in claim 15, wherein each seam has a substantially planar configuration and is a heat-fused weld.

20. The support arrangement as defined in claim 15, wherein the plurality of orifices are regularly distributed along each seam.

* * * * *